US006709185B2

(12) United States Patent
Lefevre

(10) Patent No.: US 6,709,185 B2
(45) Date of Patent: Mar. 23, 2004

(54) DEVICE FOR ASSEMBLING SEPARABLE TOOTHBRUSH ELEMENTS

(75) Inventor: Jean-Luc Lefevre, Beauvais (FR)

(73) Assignee: DuPont Industries, Beauvais (FR)

( * ) Notice: Subject to any disclaimer, the term of this patent is extended or adjusted under 35 U.S.C. 154(b) by 0 days.

(21) Appl. No.: 10/203,410

(22) PCT Filed: Jan. 11, 2001

(86) PCT No.: PCT/FR01/00079

§ 371 (c)(1),
(2), (4) Date: Oct. 16, 2002

(87) PCT Pub. No.: WO01/58307

PCT Pub. Date: Aug. 16, 2001

(65) Prior Publication Data

US 2003/0099508 A1 May 29, 2003

(30) Foreign Application Priority Data

Feb. 10, 2000 (FR) ..... 00 01641

(51) Int. Cl.[7] ..... B25G 3/24; A46B 17/00

(52) U.S. Cl. ..... 403/289; 403/322.3; 15/176.6

(58) Field of Search ..... 403/289, 290, 403/321, 322.1, 322.3, 322.4, 324, 326, 327; 15/176.6

(56) References Cited

U.S. PATENT DOCUMENTS

| | | | | |
|---|---|---|---|---|
| 5,253,948 A | * | 10/1993 | Butler | 403/289 |
| 5,365,627 A | * | 11/1994 | Jousson et al. | 15/22.1 |
| 6,079,075 A | * | 6/2000 | Velez-Juan | 15/167.1 |
| 6,237,183 B1 | * | 5/2001 | Fischer | 15/167.1 |
| 6,546,585 B1 | * | 4/2003 | Blaustein et al. | 15/167.1 |

* cited by examiner

*Primary Examiner*—John R. Cottingham
(74) *Attorney, Agent, or Firm*—Finnegan, Henderson, Farabow, Garrett & Dunner, L.L.P.

(57) ABSTRACT

The invention concerns a toothbrush whereof the neck is provided with a centering spindle having a snap-on tab at its end secured in a hole of the handle. The handle is hollowed out over its entire length with a cylindrical orifice for housing a push element whereof the stem is provided with unlocking wedges to disengage the snap-on tab and the handle. The invention is applicable to toothbrushes produced in several separable parts.

7 Claims, 2 Drawing Sheets

DEVICE FOR ASSEMBLING SEPARABLE TOOTHBRUSH ELEMENTS

The invention relates to toothbrushes made in several separable parts and it more especially concerns a device for assembling these members which enables the head and the sleeve to be separated by means of a simple, precise operation and which, at the same time, discretely blends in with the aesthetics and ergonomics of the toothbrush.

There is a wide variety of devices for snap fitting the head of a toothbrush onto a handle, but these often require the user to perform a delicate operation in order to separate the members of the brush or, on the contrary, they do not ensure that the assembly stays held together during brushing, the locking device being located in the zone on which the thumb and forefinger bear, or not sufficiently retaining the constituents of the toothbrush when it is used.

The Applicant has devoted itself to solving these problems by producing a device for assembling the separable members of an object such as a toothbrush, a device which ensures positive, robust assembly of these members and necessitates only a very simple operation in order to dismantle the whole, without excessive effort. The device is particularly adaptable to toothbrushes for children.

The main object of the invention is thus a device for assembling separable components of a toothbrush comprising a head, a neck and a handle, wherein the neck of the brush has a centring pin ending in a snap fitting tab fastening in a well in the handle, said handle presenting, over its entire length, a cylindrical opening serving to house a pusher projecting out of the handle, and comprising releasing wedges for separating the snap fitting tab from the handle.

According to other particular characteristics of the invention, the end of the snap fitting tab present chamfers converging towards the axis of the well, and said tab fastens onto shoulders of the well.

Advantageously, the releasing wedges enveloping a central recess are mounted on the end of the shank of the pusher, in the vicinity of the chamfers of the snap fastening tab.

Further characteristics and advantages of the invention will emerge from the description that follows of a non-limitative exemplary embodiment in which reference is made to the annexed drawings, wherein.

Figure 1:
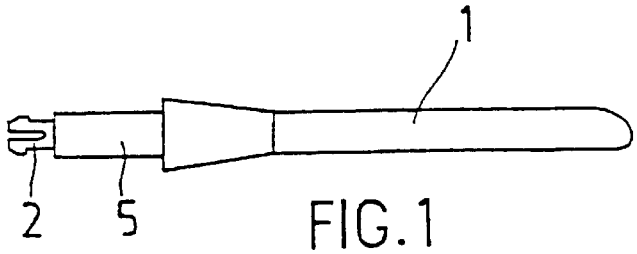
FIGS. 1 to 3 are general elevation views of the head, the handle and the pusher of the toothbrush, respectively.
Figure 2:
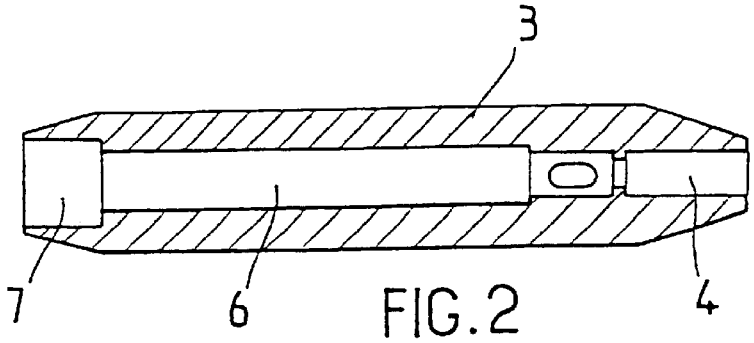
Figure 3:
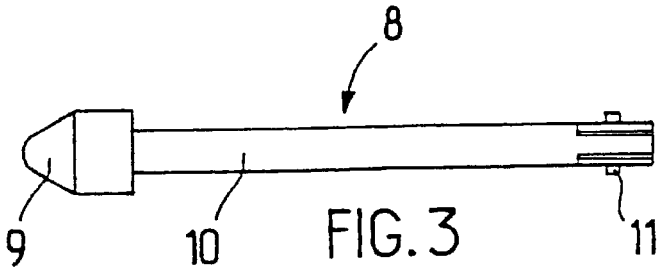

FIG. 1 shows the head 1 of a toothbrush constituting an independent member whereof one end, forming a neck, is provided with a snap fastening tab 2 at the end of a centring pin 5, which tab is designed to fasten to a handle 3, shown in FIG. 2. The handle, which has a cylindrical cross-section, is provided, for this purpose, with an end well 4 capable of receiving pin 5 of the head. Furthermore, over its entire length the handle presents a cylindrical opening 6 whereof the end, opposite from well 4, ends in a larger diameter cavity 7. The opening and the cavity of the handle serve to house a pusher 8, projecting from the handle, which is shown in FIG. 3. The pusher is essentially composed of a button 9 at the end of a shank 10, the end of which bears anti-rotation studs 11. FIGS. 4 to 7 illustrate the central snap fitting zone between head 1 and handle 3. It can be seen that tab 2 fastens onto shoulders 12 provided in well 4 of the handle. In addition, the end of tab 2 has chamfers 13 converging towards the axis of the well. Furthermore, anti-rotation guides 17 are provided on the sides of head 1 and co-operate with grooves 18 provided in the handle.

The end of shank 10 of pusher 8 is provided externally with releasing wedges 14 and internally with elastic tongues 15 enveloping a central recess 19 and ensuring that the pusher is retained in the handle. Finally, the outside of handle 3 is surrounded by an elastomeric sleeve which contributes to the aesthetic appearance of the brush.

Figure 4:
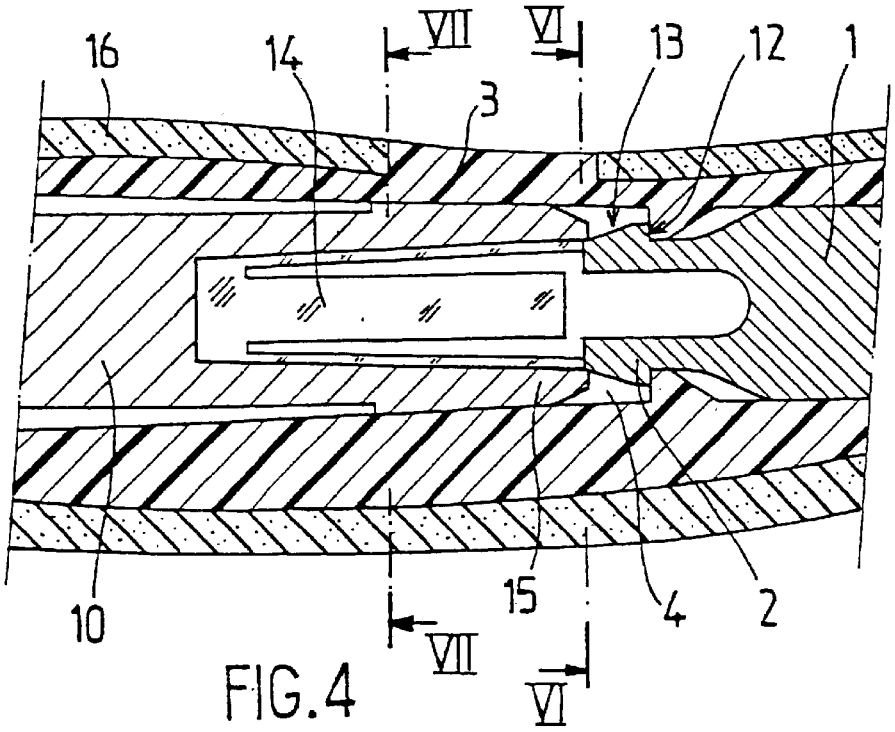
FIG. 4 is a larger scale longitudinal cross-sectional view of the central part, showing the assembly device.
Figure 5:
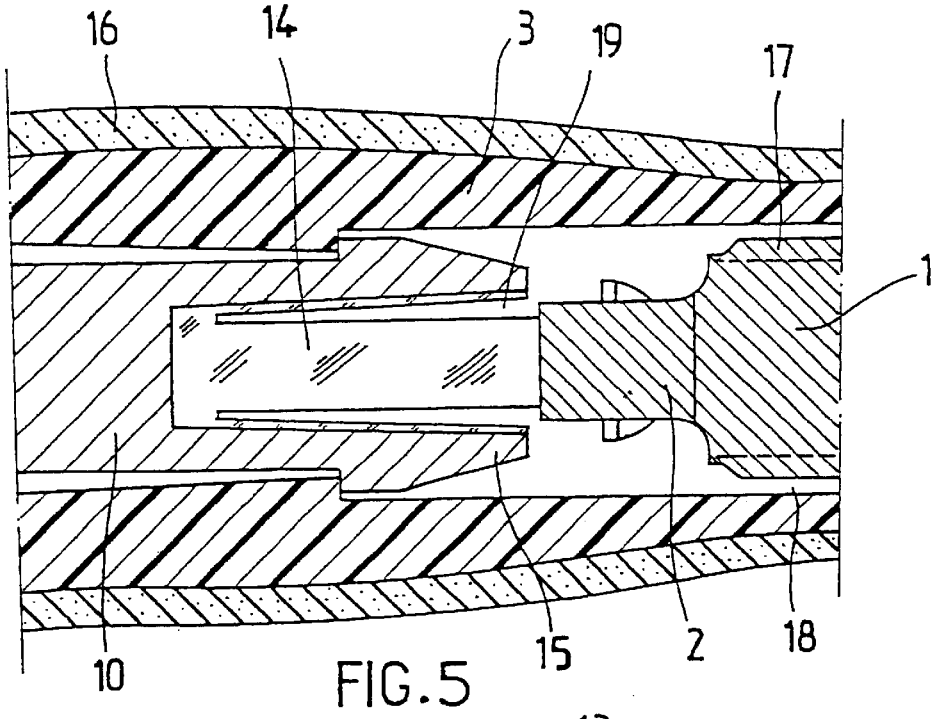
FIG. 5 is a larger scale longitudinal cross-sectional view of this central part in a plane perpendicular to the previous one.
Figure 6:
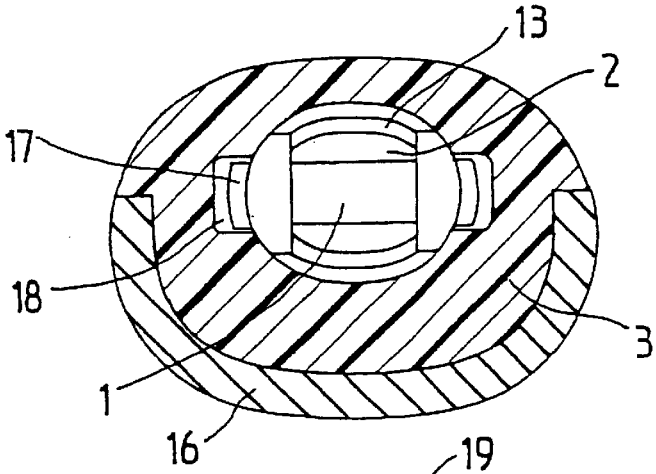
FIGS. 6 and 7 are cross-sectional views along lines VI—VI and VII—VII, respectively, of FIG. 4.
Figure 7:
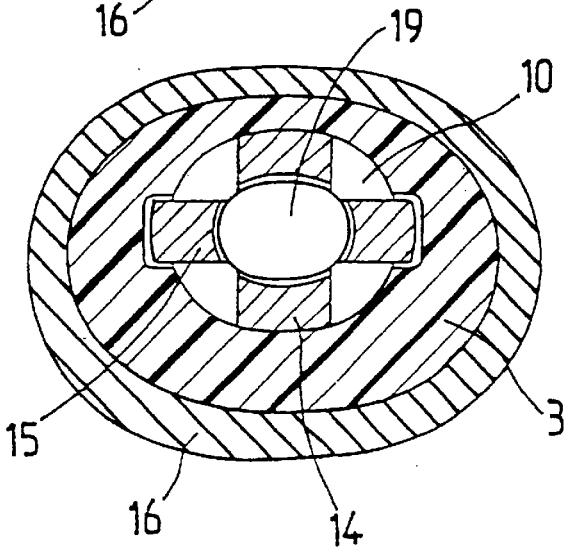

In the position shown in FIGS. 4 and 5, tab 2, bearing against shoulders 12, holds handle 3 and head 1 of the toothbrush rigidly snap fastened together. When the user wishes to separate these two pieces, he or she exerts a pressure on button 9 of pusher 8, which projects from cavity 7. The thrust exerted on shank 10 and releasing wedges 14 forces the latter to ride up over chamfers 13 of tab 2 and thus arch the wings of the tab inwards, causing it to be released from shoulders 12. In this way, it is easy to detach the head from the handle.

Elastomeric ring 16, which is advantageously coloured, contributes to the aesthetic appearance and guarantees the tightness of the assembled whole, thus creating a barrier against the infiltration of water mixed with dentifrice and saliva.

What is claimed is:

1. Device for assembling separable members of a toothbrush, comprising a head, a neck and a handle, the neck of the brush has a centering pin ending in a snap fastening tab for fastening in a well of the handle, and in that said handle presents, over its entire length, a cylindrical opening, a pusher housed in said opening and projecting out of the handle, and comprising releasing wedges for detaching the snap fastening tab from the handle.

2. Assembling device according to claim 1, wherein the end of the snap fastening tab has chamfers converging towards the axis of the well and said tab fastens onto shoulders of the well.

3. Assembling device according to claim 1, wherein the pusher includes a button at the end of a shank, the opposite end of the shank bearing anti-rotation studs.

4. Assembling device according to claims 1 or 2, wherein the releasing wedges envelop a central recess and are mounted on the opposite end of the shank of the pusher, in the vicinity of the chamfers of the snap fastening tab.

5. A toothbrush having separable parts comprising:

a head having at its distal end a neck with a snap-fastener;

a handle including an end well at its proximal end for receiving said snap-fastener for rigidly fastening the head and handle, said handle having an opening, including said end well, extending through its interior;

a pusher housed in said opening, said pusher having a distal end that protrudes from the distal end of the handle, and a proximal end incorporating releasing wedges for unfastening the snap fastener from the handle in response to a thrust upon the distal end of the pusher; and said detaching of the snap fastener being achieved without the need for relative rotation between the pusher and snap fastener.

6. A toothbrush as claimed in claim 5, wherein:

said well includes internal shoulders and said snap fastener includes a tab which fastens onto said shoulders upon insertion of the snap fastener into said well to achieve said fastening of the head and handle.

7. A toothbrush as claimed in claim 6, wherein:

said tab includes wings with external chamfers, and said releasing wedges have internal surfaces that, upon a thrust exerted on the distal end of the pusher, ride up over said chamfers to arch the wings inwardly causing the tab to be released from said shoulders and thereby said snap fastener to be unfastened from the handle.

* * * * *